United States Patent [19]

Peterson et al.

[11] 4,180,007

[45] Dec. 25, 1979

[54] ELECTROMAGNETIC BOBBIN THREAD SUPPLY ALARM

[75] Inventors: Wesley R. Peterson, Bound Brook; Wolfgang Jaffe, Roselle Park, both of N.J.

[73] Assignee: The Singer Company, New York, N.Y.

[21] Appl. No.: 3,340

[22] Filed: Jan. 15, 1979

[51] Int. Cl.[2] ..... D05B 45/00

[52] U.S. Cl. ..... 112/278

[58] Field of Search ..... 112/278, 273; 139/273 R; 242/37 R

[56] References Cited

U.S. PATENT DOCUMENTS

| | | | |
|---|---|---|---|
| 3,129,680 | 4/1964 | Doerner | 112/278 |
| 3,601,073 | 8/1971 | Simpson | 112/273 X |
| 3,991,692 | 11/1976 | Papajewski et al. | 112/278 |

FOREIGN PATENT DOCUMENTS

| | | | |
|---|---|---|---|
| 2028028 | 1/1971 | Fed. Rep. of Germany | 112/278 |
| 2056427 | 5/1972 | Fed. Rep. of Germany | 112/278 |
| 1758672 | 5/1972 | Japan | 112/278 |
| 691373 | 2/1973 | Japan | 112/278 |

*Primary Examiner*—Peter P. Nerbun

*Attorney, Agent, or Firm*—Edward P. Schmidt; Robert E. Smith; Edward L. Bell

[57] ABSTRACT

A low bobbin thread supply alarm in which a bobbin case is fitted with lever pivoted thereon and carrying a permanent magnet for travel to the hub of the bobbin. An arm overhanging the bobbin case and bobbin carries a Hall generator in a portion thereof overlying the hub of the bobbin. The lever and permanent magnet carried thereby is urged by an electromagnet supported externally of the looptaker toward and away from the hub of the bobbin at suitable intervals. When the lever pivots greater than a given amount due to depletion of thread on the hub of the bobbin the permanent magnet on the lever will trigger a voltage change on the Hall generator which may cause an appropriate alarm to provide a warning of a low thread condition.

3 Claims, 8 Drawing Figures

Fig. 2
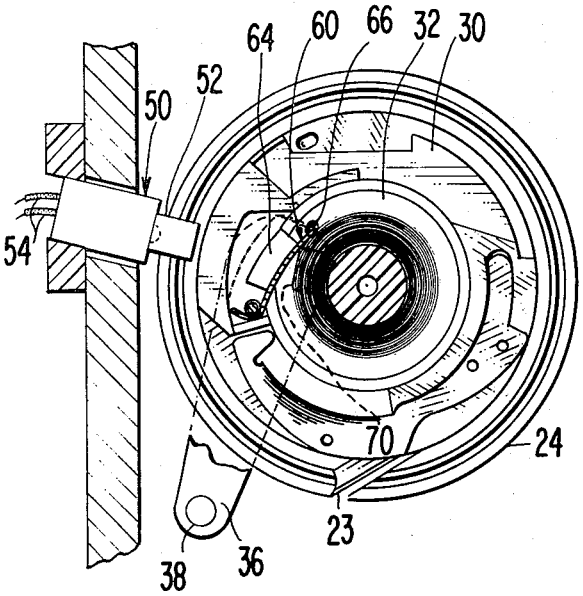
Fig. 3
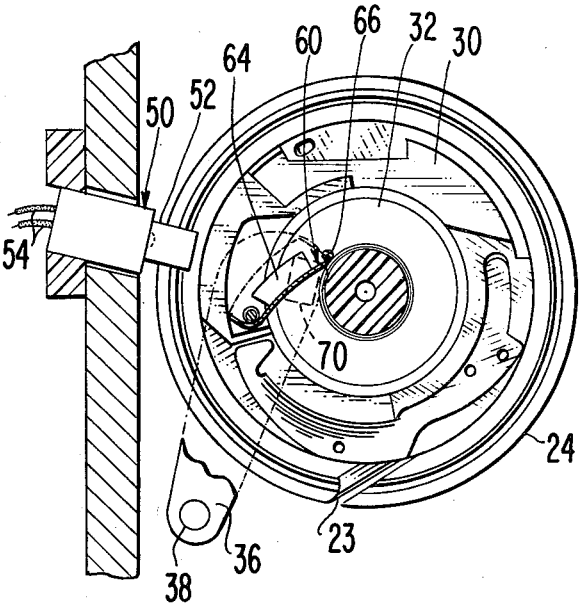
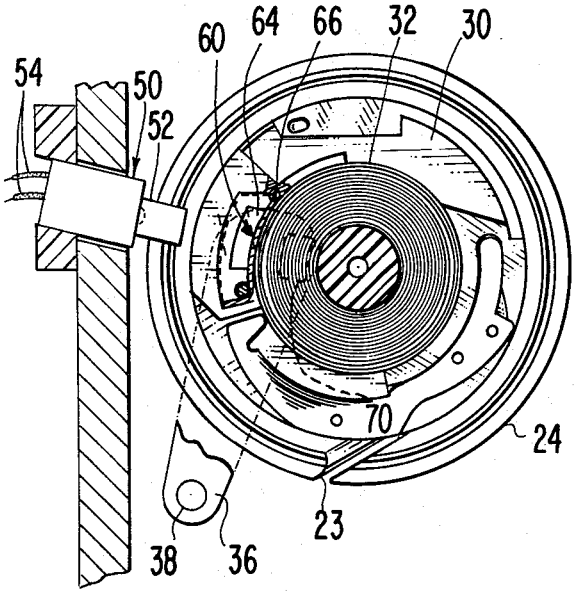
Fig. 4
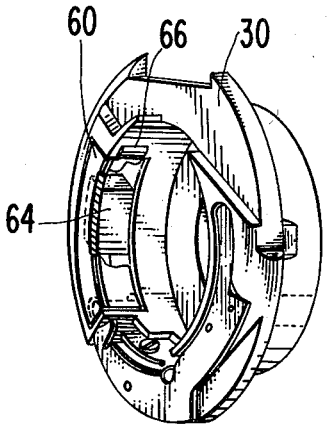
Fig. 5

ELECTROMAGNETIC BOBBIN THREAD SUPPLY ALARM

BACKGROUND OF THE INVENTION

This invention is in the field of sewing machines; more particularly, it is concerned with a low thread supply alarm for the lower thread of the lockstitch sewing machine.

Low bobbin thread supply alarms are known in the prior art. There are, for example, the devices disclosed in U.S. Pat. Nos. 3,991,692 of Papajewski et al, 3,601,073 of Simpson and 3,129,680 of Doerner. The first two patents refer to devices wherein bobbin collapse due to thread depletion is detected, while the patent of Doerner relates to use of a magnet supported adjacent a bobbin hub, which magnet is released on thread depletion to move to a position where it can actuate a Reed switch in order to provide a suitable alarm.

It is also known in the prior art to intermittently sense the condition of the bobbin thread supply in order to determine, relatively continuously, the status thereof. Such a device is shown in the Japanese Patent Publication No. 17586/72 by Ozaki, published on May 23, 1972.

It is further known in the prior art to utilize magnet sensors, for which see the Japanese Utility Model Publication No. 6913/73 of Gotoh, published on Feb. 22, 1973.

The above referred to devices are generally not ideally suited to practical use. Those devices disclosed by the U.S. patents require extra manipulation of the bobbin prior to winding, which makes their use relatively inconvenient. The devices disclosed by the Japanese patent publication of Ozaki is relatively cumbersome, and the U.M. pulication of Gotoh discloses an arrangement whose use requires an especially prepared thread supply for each bobbin.

What is required is a compact device, ideally using standard, trouble free, components, which require no special preparation for their use.

SUMMARY OF THE INVENTION

The above requirements are achieved in a device which utilizes a standard bobbin together with a compact bobbin case supporting a magnet carrying lever arrangement. The lever in the bobbin case is arranged to swing out a sidewall of the cavity receiving the bobbin, so as to swing toward the hub of the bobbin between the flanges thereof. A small magnet is carried by the lever close to the free end thereof. An electromagnet is carried by the frame of the sewing machine externally of the looptaker, with an extended pole piece overhanging the looptaker and terminating externally of the bobbin case opposite the small magnet on the lever. First circuitry is provided to vary the polarity of the electromagnet in order to urge the magnet carrying lever toward and away from the hub of the bobbin so as to have the extremity of the lever touch the hub of the bobbin. A hold down arm extends over the bobbin with a portion thereof overhanging the hub of the bobbin. A magnetic sensor carried in the portion of the hold arm overhanging the hub of the bobbin is responsive to the pesence of the small magnet in the lever, when it moves inwardly to the hub of the bobbin unimpeded by a quantity of thread on the bobbin exceeding an adjustable predetermined amount, in order to generate an output from a second circuit which may be used to generate a suitable audible or visual signal. An adjustment capability may be built into the first circuit in order to permit inward actuation of the lever periodically rather than at each stitch.

DESCRIPTION OF THE DRAWINGS

The invention comprises that devices, combinations and arrangements of parts hereinafter set forth and illustrated in the accompanying drawings of a preferred embodiment of the invention, from which the several features of the invention and the advantages obtained thereby will be readily understood by those skilled in the art.

FIG. 2 is a top plan view of the device shown in FIG. 1 as it would appear when determining the presence of a large amount of thread on the hub of the bobbin;

FIG. 3 is a view similar to FIG. 2 showing the devices as they would appear when determining the presence of small amount of thread on the hub of the bobbin;

FIG. 4 is a view similar to FIGS. 2 and 3 showing however the lever in the bobbin case in the retracted position and showing a fully laden bobbin;

FIG. 5 is a perspective view of the bobbin case showing the lever and small magnet pivoted thereto;

Referring now to FIG. 1 there is shown a sewing machine head portion 10 within which there is supported a needle bar 12 terminating in a sewing needle 13 and a presser bar 14 terminating in a presser foot 15. The sewing head portion 10 overlies in the usual fashion a sewing machine bed 18, only a portion of which is shown in cross section. Shown supported on the bed 18 is a throat plate 20 through which extends the usual feed dog 22 of a sewing machine actuated by a feeding system (not shown). As is well known in the sewing machine art, the sewing needle 13 extends through an opening (not shown) in the throat plate 20 to cooperate with a looptaker 24, supported in the bed 18 of the sewing machine, in the formation of stitches. The looptaker 24 is driven by miter gears 26 by way of feed drive shaft 28 connected in the usual fashion to a sewing machine arm shaft (not shown) so that the looptaker may rotate through two revolutions for each endwise reciprocation of the needle bar 12.

Figure 1:
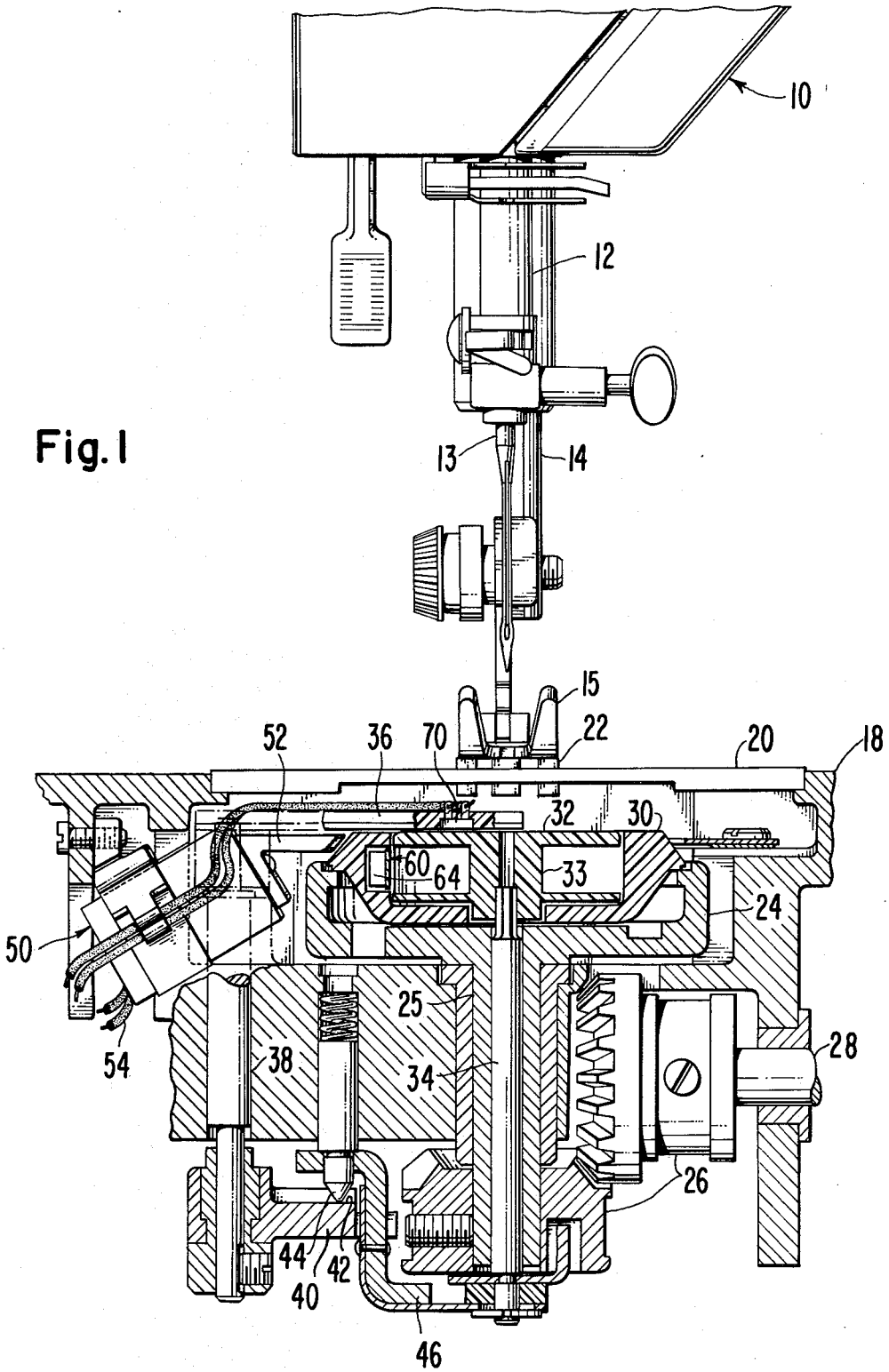
FIG. 1 is a front elevational view partly in section of a portion of the sewing machine embodying the invention.

Shown supported within the looptaker 24 is a bobbin case 30 which, in the usual fashion in sewing machines, is restrained against rotation with the looptaker. A bobbin 32 is supported within the bobbin case 30, which bobbin may be driven by driver 34 extending axially up through a looptaker shaft 25 and into engagement with the bobbin during a bobbin winding mode of operation. The driver 34 is raised to a bobbin driving position by rotation of control arm 36 which revolves fulcrum stud 38 and radial arm 40. Turning of the radial arm 40 rotates the cam surface 42 thereon, causing follower 44 and bracket 46 affixed thereto to shift upwardly carrying driver 34 therewith. For a detailed explanation of a bobbin thread replenishing mechanism which may be used the reader is referred to U.S. Pat. No. 3,693,566, issued on Sept. 26, 1972 to Ketterer which is hereby incorporated by reference herein. In that patent it is disclosed that by shifting a control arm 36 to a bobbin winding position, the bobbin driver 34 is elevated to a bobbin driving position and a loop of thread is deflected by a projection (not shown) on the control arm into the bobbin 32 in order that the needle thread may be wound upon the bobbin.

The purpose of the instant invention is to provide a low bobbin thread supply alarm for a bobbin thread replenishing mechanism as disclosed is the above referenced patent, which alarm continually tests the condition of the thread supply on the bobbin in order that relatively close monitoring of that condition may take place. To that end, certain modifications have been made to the bobbin case 30 and to the control arm 36 and an additional electromagnet 50 (see FIG. 1) has been inserted in the bed 18 for a purpose which will be explained below. The electromagnet 50 is formed with a pole piece 52 extending over the looptaker 24 to a point adjacent the bobbin case 30. Leads 54 from the electromagnet 52 extends to a special circuitry as will aslo be explained below.

Referring now to FIG. 2 there is shown a plan of the looptaker 24, bobbin case 30 and bobbin 32 therein in a half filled condition. The control arm 36 is shown partially in phantom in the stitching position. The control arm 36 would be displaced into a bobbin winding position by clockwise rotation thereof. Beneath the control arm 36 shown in phantom in FIG. 2, there is visible a lever 60 pivoted on pin 62 to the bobbin case 30. The lever 60 has affixed thereto a small magnet 64. The free end 66 of the lever 60 is curled over in order to provide a smooth surface for contacting the thread remaining on the bobbin 32.

There is supported on the end of the control arm 36 a Hall generator 70 which may be implemented by a presently available device approximately 0.015 inches thick by ⅛ inch square. With the control arm 36 in the operating position the Hall generator 70 is situated above the bobbin 32 adjacent the hub 33 thereof.

Referring now to FIG. 3 it is apparent that when the thread has been almost depleted from the hub 33 of the bobbin 32 that the lever 60 is capable of a greater degree of rotation to where the small magnet 64 underlies the Hall generator 70 and has a greater effect thereon. In FIG. 4 it can be seen that the lever 60 moves inwardly little, or not at all, if the bobbin 32 is fully wound. In FIG. 4 the small magnet 64 of the lever 60 has the least effect on the Hall generator 70 supported in the control arm 36; whereas in FIG. 3 the Hall generator would receive the greatest flux density from the magnet 64.

Figure 6:
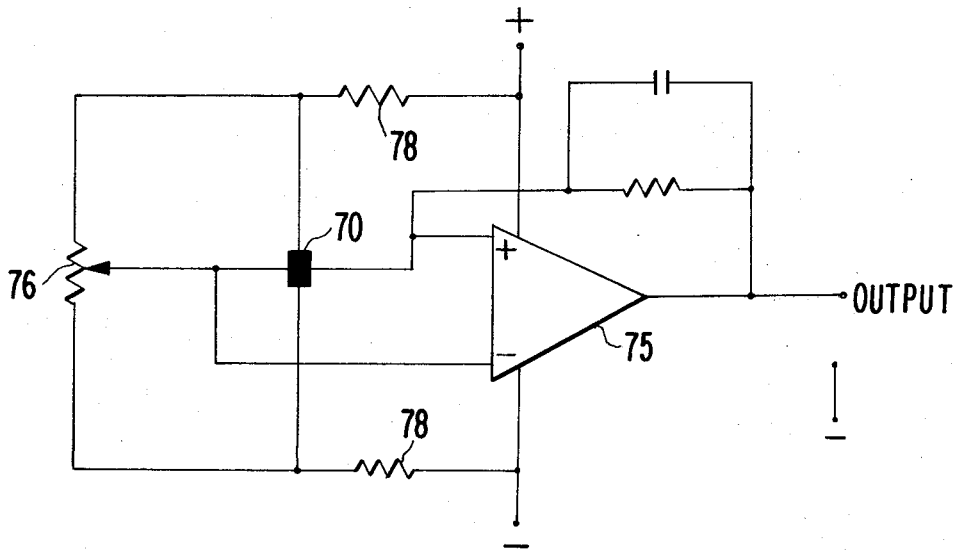
FIG. 6 is a circuit diagram for the magnetic sensor providing for adjustability of the sensitivity thereof.
Figure 8:
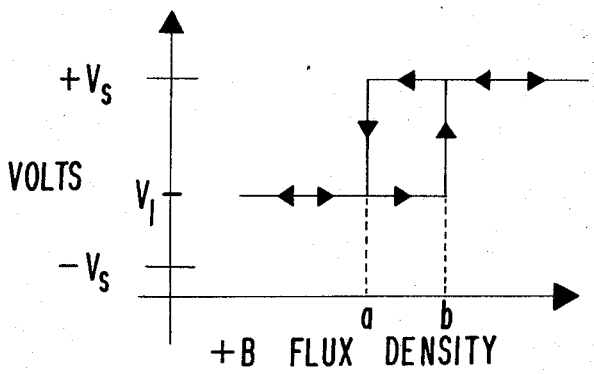

Referring now to FIG. 6 there is shown the schematic for a simple low cost circuit for use with the Hall generator 70. The circuit is triggered by the output voltage of the Hall generator 70 applied to operational amplifier 75. The point at which the circuit is triggered is varied by potentiometer 76. Current is supplied to the Hall generator 70 through the resistors 78, which are of equal value and may be selected for a desired Hall control current. The output of the circuit disclosed in FIG. 6, as indicated in FIG. 8, varies with the flux density applied to the Hall generator 70. As the flux density received by the Hall effect switch approaches the value, b, the output of the circuit in FIG. 6 would be $V_1$. When the flux density received by the Hall generator 70 is at the value, b, the output of the circuit of FIG. 6 abruptly rises to $V_s$. The elevated voltage $V_s$, may be used to trigger a visual or aural indication. If the flux density then decreases as when the bobbin thread supply is increased the voltage $V_s$ is maintained until the flux density decreases to the value a, at which point the voltage abruptly drops once again to the level $V_1$.

Figure 7:
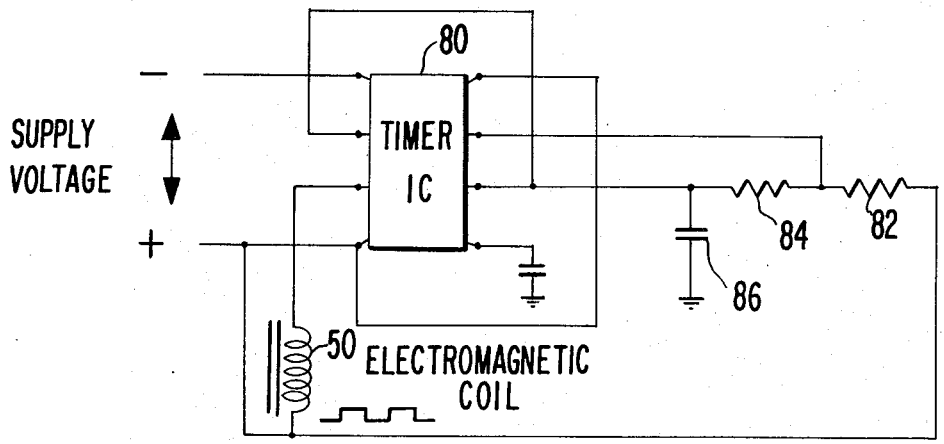
FIG. 7 is a driver circuit diagram for the electromagnet for urging the lever in the bobbin case to and from the hub of the bobbin; and, FIG. 8 is a diagram of the voltage output of the magnetic sensor in the circuit of FIG. 6, in response to the magnetic flux density applied thereto.

Referring now to FIG. 7, there is shown a circuit schematic for pivotably driving the lever 60 into and away from the hub 33 of the bobbin 32.

The heart of the circuit is an integrated circuit timer 80 which may be implemented by a National Semiconductor LM555CN. The timer 80 is connected for astable operation as an oscillator, the free running frequency and duty cycle being controlled by 2 external resistors 82, 84 and a capacitor 86. The circuit may be triggered and reset on falling waveforms. The output of the circuit is applied to the electromagnet 50 in a square wave form which alternately urges the lever 60 toward and away from the pole piece 52 of the electromagnet.

Movement of the lever 60 inwardly to the hub of the bobbin 32 may take place at any time in the stitch cycle, in as much as a loop of needle thread is cast about the bobbin case 30 and around a bobbin thread extending toward the work material from the rear of the bobbin case. Motion of the lever 60, therefore, does not interfere with the stitch forming operation of the looptaker 24.

Having thus set forth the nature of the invention what is sought to be claimed is:

1. A locksmith sewing machine having a looptaker; a bobbin case supported in said looptaker against motion therewith; a lower thread carrying bobbin carried by said bobbin case, said bobbin having a hub supporting a pair of thread retaining flanges; and an arm overhanging said looptaker, bobbin case and bobbin with a portion thereof adjacent said hub of said bobbin; wherein the improvement comprises:

a sensor supported in said portion of said arm adjacent said hub of said bobbin;

a lever pivoted on said bobbin case for rotation between said flanges of said bobbin to said hub thereof, said lever having a pivoted end and a free end and carrying a stimulus for said sensor arranged thereon increasingly to stimulate said sensor as said free end of said pivoted lever approaches said hub;

means for yieldingly urging said lever alternately toward and away from said hub of said bobbin; and, means responsive to a certain level of stimulation of said sensor for providing an indication of the approach of said free end of said lever to said hub and, thereby, of impending exhausting of bobbin thread.

2. A lockstitch sewing machine as claimed in claim 1 wherein said sensor is implemented by a Hall generator and wherein said stimulus for said sensor is implemented by a permanent magnet supported by said lever.

3. A lockstitch sewing machine as claimed in claim 2 wherein said means for yielding urging said lever alternately toward and away from said hub of said bobbin is implemented by an electromagnet having a pole piece aligned with said permanent magnet of said lever and means for alternately reversing the polarity of said pole piece.

* * * * *